US010160566B2

(12) United States Patent
McKenzie et al.

(10) Patent No.: US 10,160,566 B2
(45) Date of Patent: Dec. 25, 2018

(54) RESEALABLE BEVERAGE CONTAINER

(71) Applicant: Exal Corporation, Youngstown, OH (US)

(72) Inventors: John Samuel McKenzie, Youngstown, OH (US); Nicholas E. Stanca, Youngstown, OH (US); Jeffrey Silver Taggart, Youngstown, OH (US)

(73) Assignee: Exal Corporation, Youngstown, OH (US)

( * ) Notice: Subject to any disclaimer, the term of this patent is extended or adjusted under 35 U.S.C. 154(b) by 0 days.

(21) Appl. No.: 15/353,425

(22) Filed: Nov. 16, 2016

(65) Prior Publication Data

US 2017/0137163 A1 May 18, 2017

Related U.S. Application Data

(60) Provisional application No. 62/255,560, filed on Nov. 16, 2015.

(51) Int. Cl.
*B65D 1/02* (2006.01)
*B65D 41/02* (2006.01)
(Continued)

(52) U.S. Cl.
CPC ..... *B65D 1/0246* (2013.01); *B65D 7/04* (2013.01); *B65D 41/023* (2013.01); *B65D 41/04* (2013.01);
(Continued)

(58) Field of Classification Search
CPC .... B65D 1/0246; B65D 1/023; B65D 1/0223; B65D 7/04; B65D 41/023; B65D 41/04;
(Continued)

(56) References Cited

U.S. PATENT DOCUMENTS 730,510 A 6/1903 Beach
1,977,589 A * 10/1934 Merolle ..... B65D 41/06 215/330
(Continued)

FOREIGN PATENT DOCUMENTS

DE 833599 3/1952
FR 1126491 11/1956
(Continued)

OTHER PUBLICATIONS

Form PCT/ISA/220, PCT Notification of Transmittal of the International Search Report and the Written Opinion of the International Searching Authority, or the Declaration, PCT/US2016/062293, dated Jan. 11, 2017.
(Continued)

*Primary Examiner* — Robert J Hicks
(74) *Attorney, Agent, or Firm* — Paul D. Bangor, Jr.; Clark Hill PLC

(57) ABSTRACT

A resealable beverage container comprising: a cylindrical body having an open first end portion and a closed second end portion; a radially inwardly extending ledge disposed circumferentially at the open first end portion; a neck section disposed upward from the ledge terminating in an upper edge in an outward curled seal lip defining a pour opening; neck section having a generally cylindrical central upper part having a first diameter; a first set of lug channels formed inward to first diameter about central upper part for cooperation with a removable cap closure member covering the pouring opening and including a top wall and a cap body shaped to extend downward from top wall around the central upper part, cap body terminating in a generally circular lower rim; and a set of lugs inward within cap body to a second diameter less than first diameter to be received in lug channels to retain cap closure member onto neck portion.

11 Claims, 7 Drawing Sheets

(51) Int. Cl.
*B65D 41/04* (2006.01)
*B65D 8/00* (2006.01)

(52) U.S. Cl.
CPC ..... *B65D 41/0407* (2013.01); *B65D 41/0435* (2013.01)

(58) Field of Classification Search
CPC . B65D 41/0407; B65D 41/0435; B65D 41/06
USPC ..... 215/45, 44, 43, 332, 329, 316; 220/300, 220/301, 296, 293, 288
See application file for complete search history.

(56) References Cited

U.S. PATENT DOCUMENTS 3,927,783 A * 12/1975 Bogert ..... B65D 41/06 215/222
4,373,641 A * 2/1983 Banich, Sr. ..... B65D 41/04 215/331
5,322,177 A 6/1994 Coggings
5,529,202 A * 6/1996 Shamis ..... A47G 19/2272 220/295
6,082,565 A * 7/2000 Harrold ..... B65D 50/04 215/218
6,415,935 B1 7/2002 Hins
2001/0019033 A1* 9/2001 Montgomery ..... B65D 41/065 215/332
2004/0007556 A1* 1/2004 Manera ..... B65D 41/06 215/332
2005/0121406 A1* 6/2005 Brozell ..... B65D 50/043 215/216
2007/0062900 A1* 3/2007 Manera ..... B65D 41/06 215/222
2009/0178995 A1 7/2009 Tung
2015/0329232 A1* 11/2015 Brozell ..... C03B 9/325 215/44

FOREIGN PATENT DOCUMENTS

GB 879330 A * 10/1961 ..... B65D 41/06
GB 995890 6/1965
JP 2010023907 2/2010

OTHER PUBLICATIONS

Form PCT/ISA/210, PCT International Search Report for International Application No. PCT/US2016/062293, dated Jan. 11, 2017.
Form PCT/ISA/237, PCT Written Opinion of the International Searching Authority for International Application No. PCT/US2016/062293, dated Jan. 11, 2017.
Form PCT/IB/326, PCT Notification Concerning Transmittal of International Preliminary Report on Patentability, PCT/US2016/062293, dated May 31, 2018.
Form PCT/IB/373, PCT International Preliminary Report on Patentability for International Application No. PCT/US2016/062293, dated May 31, 2018.

* cited by examiner

RESEALABLE BEVERAGE CONTAINER

CROSS REFERENCE TO RELATED APPLICATIONS

This application claims the benefit of the filing date of U.S. provisional patent application Ser. No. 62/255,560, filed on Nov. 16, 2015, the entirety of which is incorporated herein by reference for all purposes.

BACKGROUND

One type of known metal beverage container has a screw-on closure cap. With this type of metal container, an open end of the container may be opened and resealed using the screw-on closure cap. These containers generally resemble screw top bottles having a necked-in upper portion terminating at a threaded open end. Another type of known metal beverage container includes a curled rim or lip at the open end. Each of these types of containers may be formed using an impact extrusion process. Impact extrusion is a process utilized to make metal containers and other articles with unique shapes. The containers are typically made from a softened metal slug comprised of steel, magnesium, copper, aluminum, tin, and lead and other alloys. The container is formed inside a confining die from a cold slug which is contacted by a punch. The force from the punch deforms the metal slug around an outer diameter of the punch and the inner diameter of the confining die. After the initial shape is formed, the container is removed from the punch with a counter-punch ejector, and other necking and shaping tools are used to form the container to a preferred shape. Presently, the impact extrusion containers are mechanically finished by separate forming devices with a thread and/or a curled rim or lip. The threaded only metal containers can have a sharp edge which is unacceptable for drinking. The metal containers with only a curled rim or lip are not resealable.

Recently, lug-type resealable closure systems have been introduced into the metal beverage container market. These closure systems include a set of elongated outwardly extending lugs formed (e.g., by an embossing process) about the container at an upper neck portion. These lugs cooperate with a second set of inwardly extending lug members formed in a curled rim of a cap. When the cap is attached to the upper neck portion, the cooperating lug members draw the cap against a curled seal rim or lip mechanically formed on the container. Although the lug-type closure systems overcome some of the drawbacks of the threaded closures because the relatively expensive operation of threading the wall of the container body is avoided, the metal containers having these lug-type closures together with the curled seal rim or lip cannot be reliably impact extruded which can increase the cost of manufacturing.

SUMMARY

One aspect of a preferred embodiment of the present disclosure comprises a resealable beverage container comprising: a cylindrical body having an open first end portion and a closed second end portion; a radially inwardly extending ledge disposed circumferentially on the body at the open first end portion; a neck section disposed upward from the ledge terminating in an upper edge in an outward curled seal lip defining a pour opening; said neck section having a generally cylindrical central upper part, the outer surface of the central upper part having a first diameter; a first set of lug channels defined by the central upper part and formed inward to the first diameter about the central upper part for cooperation with a cap closure member; a removable cap closure member covering the pouring opening and including a top wall and a cap body shaped to extend downward from said top wall around the central upper part, said cap body terminating in a generally circular lower rim; and a set of lugs formed or attached inward within the cap body of the cap closure member to a second diameter less than the first diameter to be received in the lug channels to retain the cap closure member onto the neck portion.

In another aspect of a preferred resealable beverage container of the present disclosure, each of the lugs is generally hemispherical.

In yet another aspect of a preferred resealable beverage container of the present disclosure, each of the lugs is attached or formed on an inner surface of the cap body without substantial blemish to an outer surface of the cap body.

In another aspect of a preferred resealable beverage container of the present disclosure, the lower rim of the cap body extends continuously around the cap body.

In yet another aspect of a preferred resealable beverage container of the present disclosure, the lower rim of the cap body extends continuously around the cap body and defines no part of the lugs.

In another aspect of a preferred resealable beverage container of the present disclosure, each of the lug channels comprises a horizontally extending end section, a central section canted upwardly from the end section and an upward extending entrance/exit ramp section opposite the horizontally extending end section.

In a further aspect of a preferred resealable beverage container of the present disclosure, the cumulative length or wrap of the lug channels about the neck section is less than the circumference of neck section leaving spaces therebetween.

In another aspect of a preferred resealable beverage container of the present disclosure, the lug channels define guide channels dimensioned to receive corresponding lugs on the cap closure member during closing and opening of the resealable beverage container.

In an additional aspect of a preferred resealable beverage container of the present disclosure, the lug channels define guide channels dimensioned to receive corresponding lugs on the cap closure member during closing and opening of the resealable beverage container.

In another aspect of a preferred resealable beverage container of the present disclosure, each of the lugs is formed by indenting the cap body from the outside so that each lug extends inwardly from an inner surface of the cap body.

In yet another aspect of a preferred resealable beverage container of the present disclosure, the seal lip defines a seal surface; the top wall is partially concave and together with the cap body defines a seal channel dimensioned to receive the seal surface in a closed position of the cap closure member on the neck section.

In an additional aspect, a preferred resealable beverage container of the present disclosure further comprises a seal member within the seal channel wherein the seal member is compressed against the seal surface and the top wall when the cap closure member is in place on the neck portion.

In a further aspect of a preferred resealable beverage container of the present disclosure, each of the lug end sections defines a wall which provides a rotational limit for the cap closure member lugs within the lug channels during attachment of the cap member to the neck section.

In another aspect of a preferred resealable beverage container of the present disclosure, each of the lug end sections is disposed around the neck section at a level below the seal surface to keep the cap closure member and the seal member in tension against the seal surface.

A metal resealable container comprises a container and a cap member. An open end position of the container includes a neck section forming a spout on a container body. The neck section includes an upper end with an opening having a surrounding rim or lip defining a seal surface, which, in turn, defines a dispensing opening. Circumferentially spaced thread lugs are inwardly formed (e.g., by debossing) on the neck section. Each of the thread lugs includes an end section, a central section canted upwardly from the end section and an upwardly extending ramp section, with the sections together defining a guide channel. The removable cap member has a body adapted to cover the dispensing opening. A set of lugs is formed on an inner surface of the cap member body and are adapted to move through the guide channels as the cap member rotated on the neck section.

DETAILED DESCRIPTION

Figure 1:
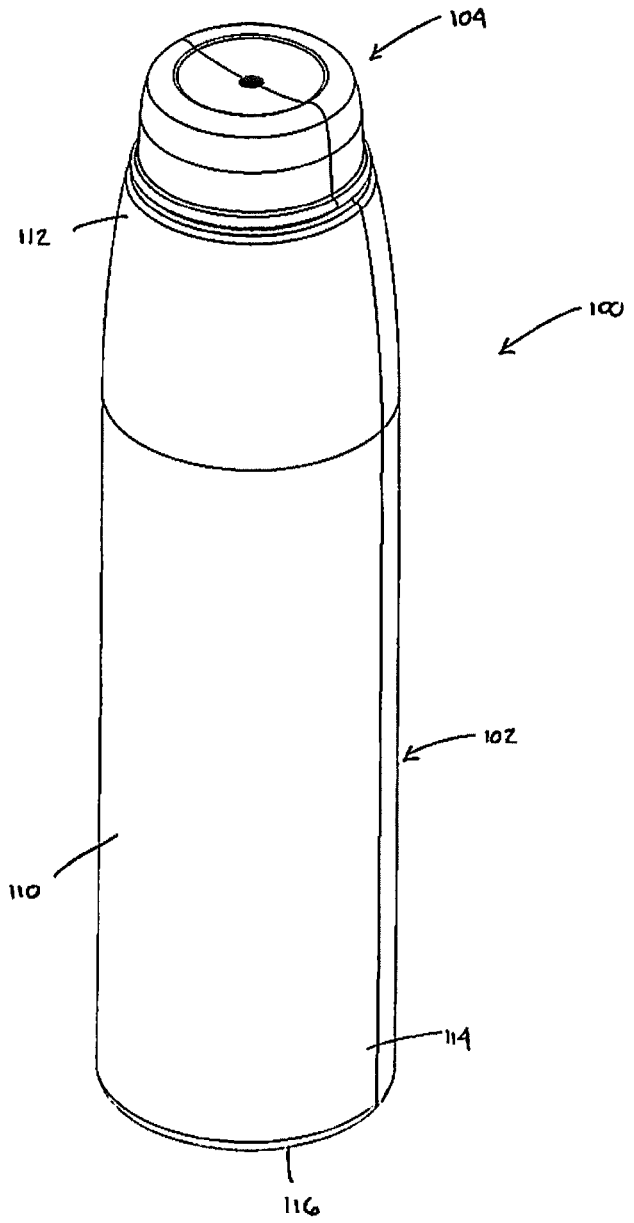
FIG. 1 is a perspective view of a metal resealable beverage container assembly including a container and a cap member according to the present disclosure.
Figure 2:
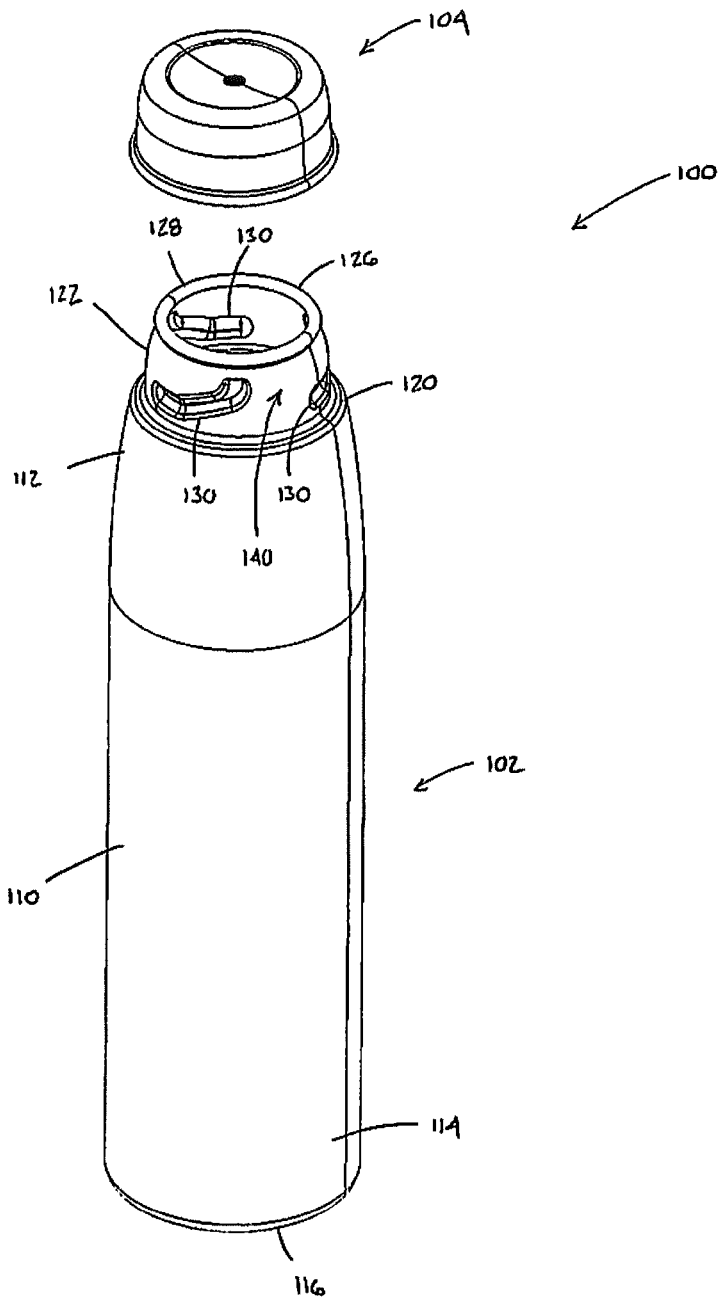
FIG. 2 is an exploded perspective view of the container assembly of FIG. 1.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIGS. 1 and 2 illustrate a metal resealable beverage container assembly 100 including a container 102 and a cap member 104 according to the present disclosure. The container 102 includes a cylindrical shaped body 110 having an open first end portion 112 and a second end portion 114 closed by a bottom wall 116. A radially inwardly extending ledge 120 provided circumferentially on the body 110 is located at the open first end portion 112. A neck section 122 is formed upward from the ledge 120 and terminates in an upper edge in an outward curled seal rim or lip 126 which defines a seal surface 128. The rim 126 can function as an opening for drinking or a pour opening for dispensing contents of the container 102, and also provides a fill opening. The neck section 122 is depicted as an integral piece of the body 110, but may be a separate structure from the body 110 if desired.

Figure 3:
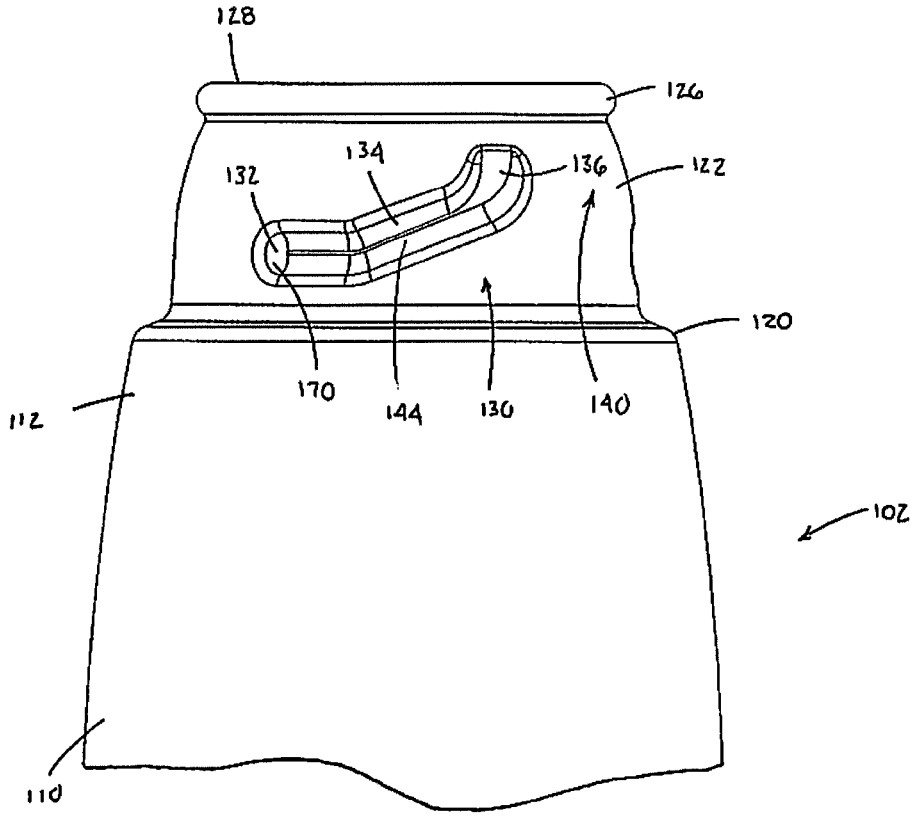
FIG. 3 is an enlarged partial side view of the container of FIG. 1.
Figure 4:
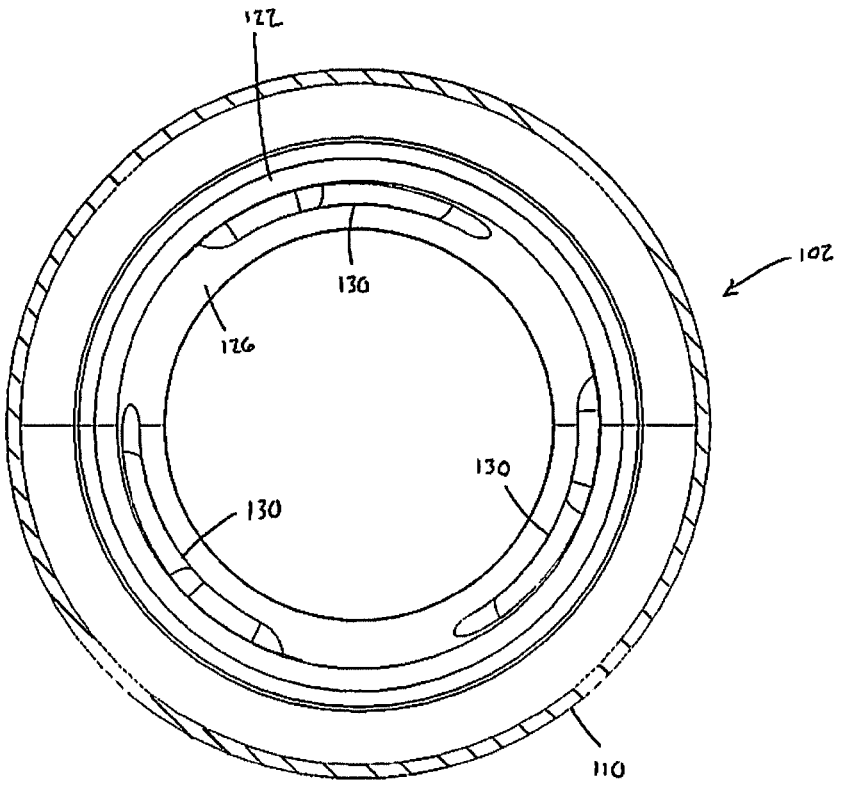
FIG. 4 is a bottom cross-sectional view of the container of FIG. 1.

As best depicted in FIGS. 3 and 4, extending inward from the neck section 122 are thread lug channels 130, shown (by way of example and not limitation) as three in number, which allow the cap member 104 to be threaded onto the neck section 122. Each thread lug channels 130 includes a horizontally extending end section 132; a central section 134 canted upwardly from the end section 132; and an upward extending entrance/exit ramp section 136 at the other or second end of the lug channel 130. The cumulative length or wrap of the lug channels 130 about the container neck section 122 is less than the circumference of the neck section leaving spaces 140 there between. The lug channels 130 define guide channels 144 dimensioned to receive corresponding lugs 142 provided on the cap member 104 (see FIGS. 5 and 6) during closing and opening of the container assembly 100. It should be appreciated that the lug channels 130 can have a reverse configuration, such that they would function as a left-hand (or reverse) thread if such a feature were desired for some reason.

Figure 5:
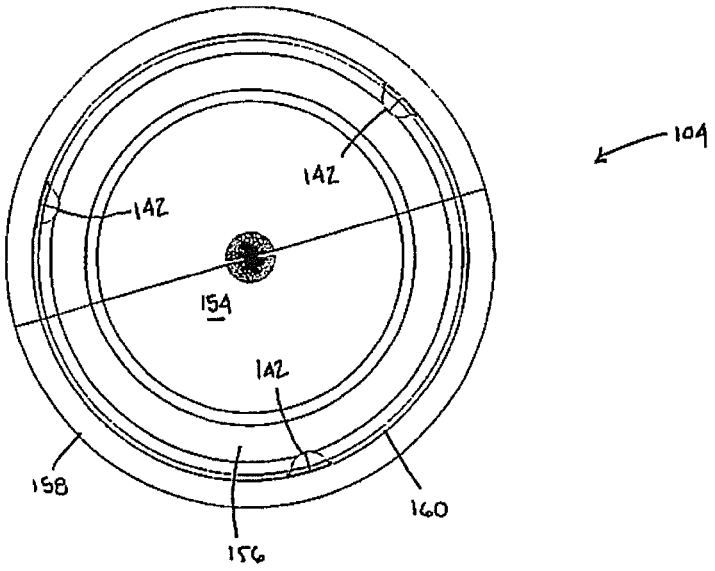
FIG. 5 is a bottom view of the cap member of FIG. 1.
Figure 6:
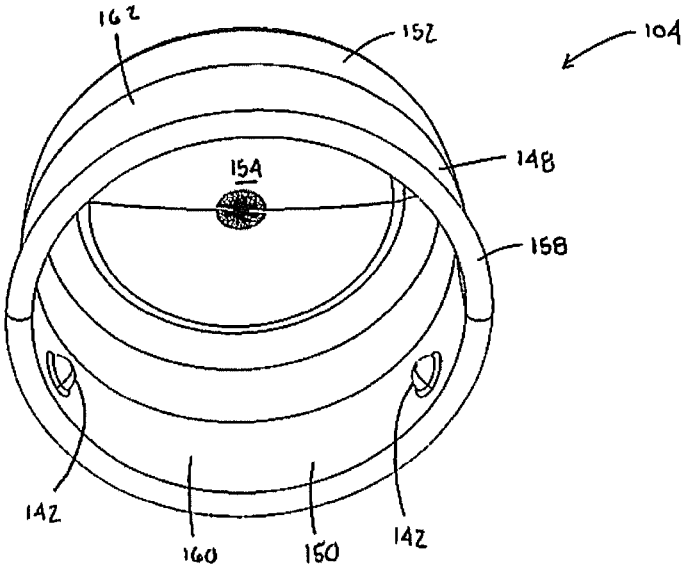
FIG. 6 is a perspective view of the cap member of FIG. 1.
Figure 7:
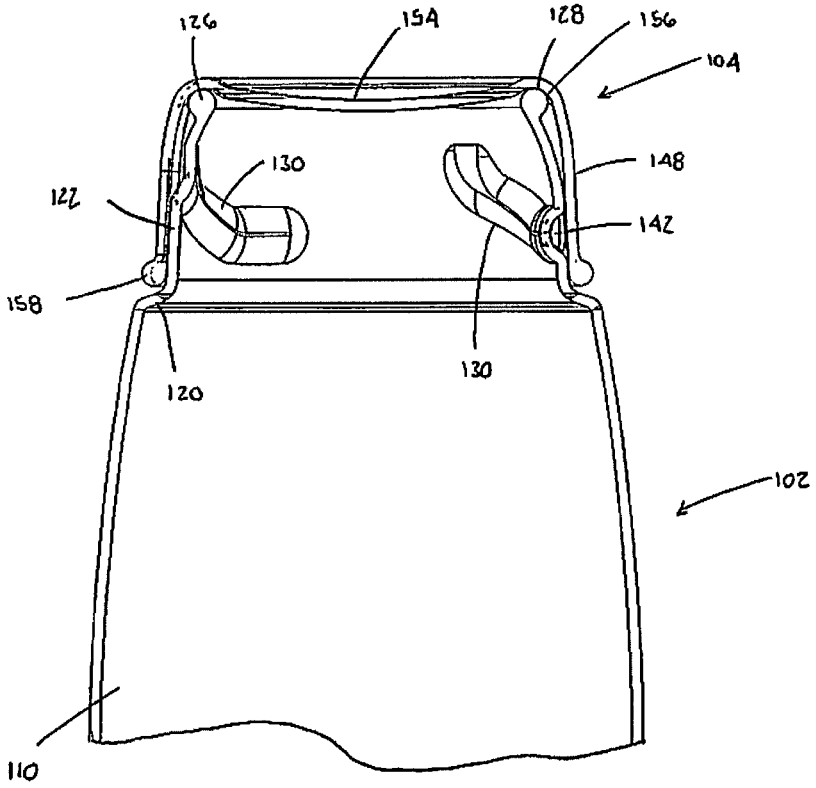
FIG. 7 is an enlarged partial side view of the container assembly of FIG. 1.

With reference to FIGS. 5 and 6, the cap member 104 is in the general form of an inverted cup, including a cylindrical shaped body 148 having an open first end portion 150 and a second end portion 152 closed by a top wall 154. The body 148 is shaped to surround the neck section 122. The top wall can be partially concaved and together with the body 148 define a channel 156 dimensioned to receive the rim 126 in a closed position of the cap member 104 on the neck section 122 (see FIG. 7). An outwardly curled lower rim 158 is provided at the second end portion 152. The lugs 142 are formed on an inner surface 160 of the body 148. As depicted, the lugs 142 extend radially inward from the inner surface 160 and are spaced axially a predetermined distance from the rim 158. With this configuration, the rim 158 extends continuously and without interruption about the first end portion 150. In other words, the lugs 142 are not formed from or defined by the rim 158. Further, as depicted, the lugs 142 are formed on the inner surface 160 without substantial blemish (e.g., indentation) of an outer surface 162 of the body 148. However, the lugs 142 could also be formed by indenting the body 148 from the outside so that the lugs 142 extend inwardly from the inner surface 160, which would be generally cylindrical in configuration but for where the lugs extend inwardly therefrom. The lugs 142 preferably may be any geometric or non-geometric shape including without limitation spherical, square, rectangular, triangular or hemispherical to allow for easy movement through the guide channels defined by the lug channels 130; although no specific shape is required. Additionally, an elastomeric preferably circular seal (not shown), which may take different forms, can be fitted within the channel 156 of the cap member 104 so that in the closed position of the cap member 104 the seal is held against the entire periphery of seal surface 128.

Figure 8:
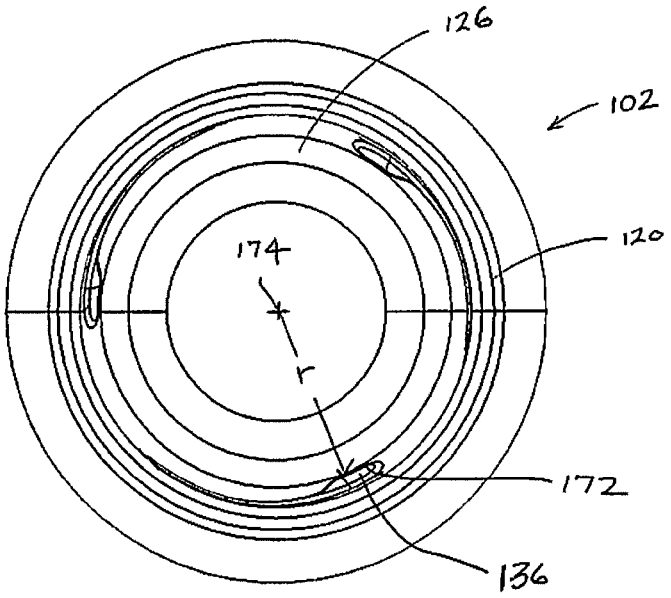
FIG. 8 is a top view of the container of FIG. 1.

With reference back to FIG. 3, each of the lug end sections 132 includes a wall 170 which provides a rotational limit for the cap member lugs 142 within the guide channels 144 during attachment of the cap member 104 to the neck section 122. The end sections 132 further extend around the neck section 122 at a level below the seal surface 128 which is determined to keep the cap member interior and its seal, if provided, in tension against the seal surface 128. Each of the ramp sections 136 is adapted to allow for easy entrance/exit of the lugs 142. As seen in FIG. 8, a first (upper) end 172 of each of the ramp sections 136 is spaced a distance r from a central axis 174 of the container 102, and the outer diameter (OD) of the curled lip 126 is generally equal to 2r. For purposes of explanation, assume the cap member 104 is attached to the neck section 122, with cap member lugs 142 moved through the guide channels 144 of the lug channels 130 and tightened by rotating it clockwise (as viewed from the top), such that the cap member lugs 142 engage the walls 170 of the lug channels 130 (see FIG. 7). Assume also that the container contents are (or will be) under pressure and there is a force component due to such pressure on the interior of cap member 104. To release or vent such pressure, the cap member can be rotated counterclockwise until the lugs 142 move through the end sections 132 into the central sections 134 and toward the ramp sections 136. This causes the top wall 154 of the cap member 104 to lift upwardly from the seal surface 128 thereby releasing the internal pressure of the container 102. Once the pressure within the container 102 essentially equates with ambient pressure, the cap member 104 can be further rotated to move the lugs 142 through the ramp sections 136 and out of the guide channels 144 of the lug channels 130 allowing the cap member 104 to by fully removed.

According to the present disclosure, the exemplary container 102 is formed by impact extrusion. In the impact extrusion process, a slug of suitable dimensions is placed in a hollow die. A punch impacts the slug at very high speed and pressure, causing the metal of the slug to flow upwardly in the interstitial space defined between the punch outer diameter and the die inner diameter. This forms the thin wall container 102 as shown in FIGS. 1 and 2. It should be appreciated that the dimensions of the slug will vary depending on the size container which is to be formed. After the container 102 has been formed, it is cleaned, and if desired painted or lacquered. After this process, the neck section 122 is formed on the container 102 in what is commonly called a necking process. In a conventional manufacturing process, the open edge portions of the container 102 (which edges are usually somewhat uneven after the extrusion process) are trimmed, to provide a straight, smooth edge. The trimmed container is then thrust sequentially into a set of forming or necking dies, to form the reduced diameter neck section 122. The formation of the lug channels 130 on the neck section 122 can be performed in a separate debossing process, and the outward curled seal rim or lip 126 is formed by a subsequent curling operation performed on the neck section 122. Details of the debossing and curling operations are generally known in the art; however, formation of the outward rim 126 is preferably after formation of the lug channels 130 in order to maintain the desired dimensions between the rim 126 and the lug channels 130. This assures that the proper closing and sealing force is applied between the cap member 104 (and the seal typically provided on an underside of the cap member) and the seal surface 128 of the container 102. The lugs 142 of the cap member 104 can be formed on the inner surface 160 of the body 148 by conventional manners, with the exception that the outer surface 162 of the body 148 is without substantial blemish (e.g., indentation) from the lugs 142. As mentioned above, the lugs 142 could also be formed by indenting the body 148 from the outside.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the disclosure.

What is claimed is:

1. A resealable beverage container comprising:

a cylindrical body having an open first end portion and a closed second end portion;

a radially inwardly extending ledge disposed circumferentially on the body at the open first end portion;

a neck section disposed upward from the ledge terminating in an upper edge in an outward curled seal lip defining a pour opening;

said neck section having a generally cylindrical central upper part, the outer surface of the central upper part having a first diameter;

a plurality of sets of lug channels defined by the central upper part and formed inward to the first diameter about the central upper part for cooperation with a removable cap closure member, wherein each of the set of lug channels comprises a horizontally extending end section, a central section canted upwardly from the horizontally extending end section and an upward extending entrance/exit ramp section opposite the horizontally extending end section;

wherein the removable cap closure member covers the pouring opening and includes a top wall and a cap body shaped to extend downward from said top wall around the central upper part, said cap body terminating in a generally circular lower rim; and a set of lugs formed or attached inward within the cap body of the cap closure member to a second diameter less than the first diameter; wherein each lug of the set of lugs is received in a different one of the set of lug channels to retain the cap closure member onto the neck portion; and wherein each of the horizontally extending end section, the central section and the upward extending entrance/exit ramp section comprises a pair of opposing sidewalls spaced apart from each other by a first distance, wherein each of the opposing sidewalls defines a guide channel and the first distance is set so that the guide channels of each pair of opposing sidewalls may receive a portion of a corresponding lug on the cap closure member during closing and opening of the resealable beverage container.

2. The resealable beverage container of claim 1, wherein each of the lugs is generally hemispherical.

3. The resealable beverage container of claim 1, wherein each of the lugs is attached or formed on an inner surface of the cap body without substantial blemish to an outer surface of the cap body.

4. The resealable beverage container of claim 1, wherein the lower rim of the cap body extends continuously around the cap body.

5. The resealable beverage container of claim 1, wherein the lower rim of the cap body extends continuously around the cap body and defines no part of the lugs.

6. The resealable beverage container of claim 1, wherein the cumulative length or wrap of the lug channels about the neck section is less than the circumference of neck section leaving spaces therebetween.

7. The resealable beverage container of claim 1, wherein each of the lugs is formed by indenting the cap body from the outside so that each lug extends inwardly from an inner surface of the cap body.

8. The resealable beverage container of claim 1, wherein the seal lip defines a seal surface; the top wall is partially concave and together with the cap body defines a seal channel dimensioned to receive the seal surface in a closed position of the cap closure member on the neck section.

9. The resealable beverage container of claim 8, further comprising a seal member within the seal channel wherein the seal member is compressed against the seal surface and the top wall when the cap closure member is in place on the neck portion.

10. The resealable beverage container of claim 9, wherein each horizontally extending lug end section of the plurality of sets of lug channels is disposed around the neck section at a level below the seal surface to keep the cap closure member and the seal member in tension against the seal surface.

11. The resealable beverage container of claim 1, wherein each of the horizontally extending lug end sections defines an end wall which provides a rotational limit for the cap closure member lugs within the lug channels during attachment of the cap member to the neck section.

* * * * *